US007044827B1

(12) United States Patent
Krull

(10) Patent No.: US 7,044,827 B1
(45) Date of Patent: May 16, 2006

(54) HAND-HELD AMUSEMENT DEVICES AND METHODS INVOLVING SAME

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 246 days.

(21) Appl. No.: 10/630,435

(22) Filed: Jul. 29, 2003

(51) Int. Cl.
*A63H 33/00* (2006.01)

(52) U.S. Cl. ..... 446/491

(58) Field of Classification Search ..... 446/1, 446/71, 491, 227; 472/137
See application file for complete search history.

(56) References Cited

U.S. PATENT DOCUMENTS 847,086 A * 3/1907 Hall ..... 123/188.2
2,402,861 A * 6/1946 Winnick ..... 446/227
5,069,646 A * 12/1991 Hanson et al. ..... 446/85
5,454,745 A * 10/1995 Spielberger ..... 446/71
5,584,531 A * 12/1996 Bowman ..... 297/245
5,788,253 A * 8/1998 Thomson et al. ..... 280/87.041
6,491,562 B1 * 12/2002 Jackson ..... 446/71

* cited by examiner

*Primary Examiner*—Kien Nguyen

(57) ABSTRACT

A hand-held amusement device has a variety of features that encourage manipulative activities in and/or by a person's hand. These features may include various combinations of a base that is configured for rocking back and forth on a support surface; a cylinder that rotates relative to the base; a plunger that telescopes relative to the base; a clip that slides back and forth on the base; a lever that pivots back and forth on the base; a hole that extends through an end of the base to facilitate twirling of the device about a finger; at least one word embossed in braille on the base; and a spherical ball that is rotatably mounted in the base and protrudes outward from the base. The base may also be configured for rotation about three orthogonal axes while supported in respective positions between a person's thumb and an opposing finger.

28 Claims, 5 Drawing Sheets

Fig. 1
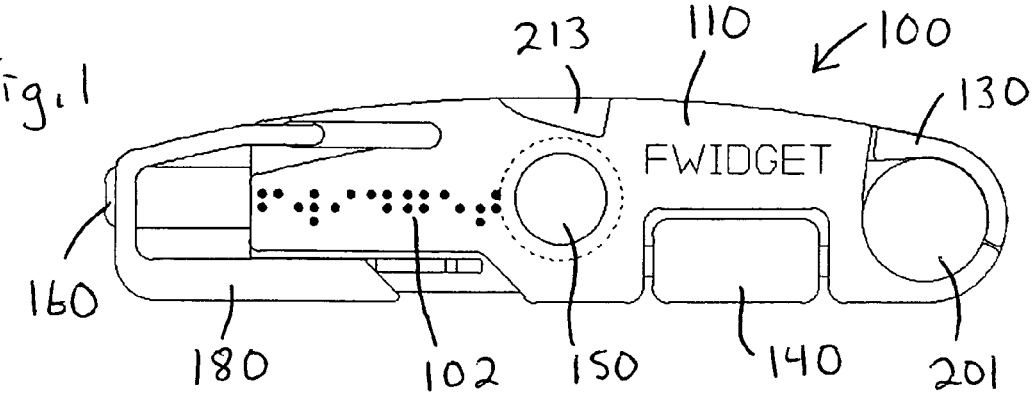
Fig. 2
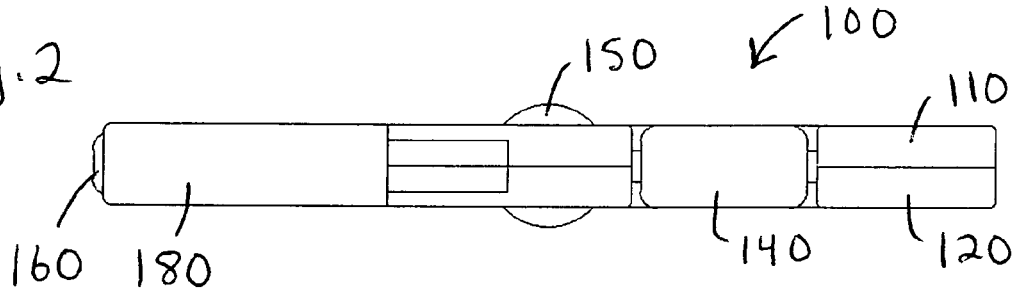
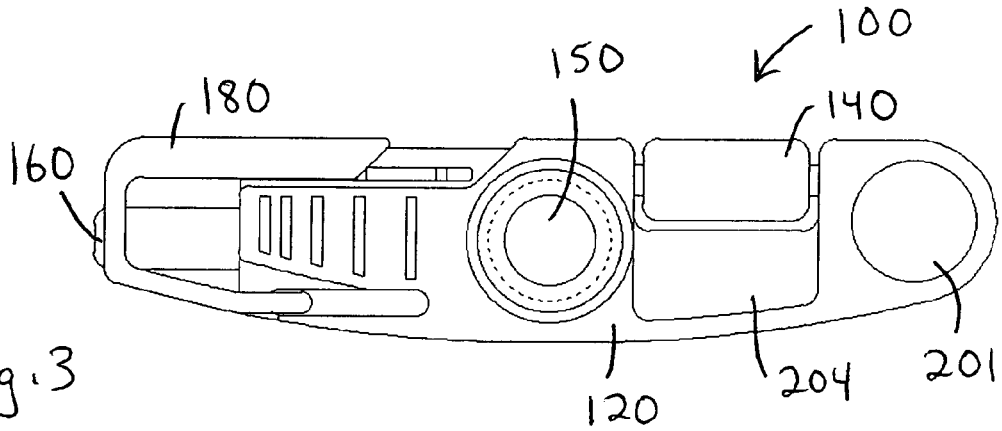
Fig. 3
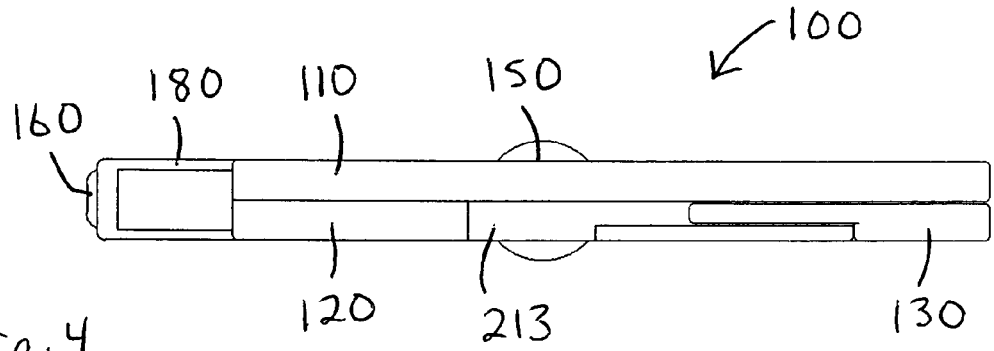
Fig. 4

Fig. 5
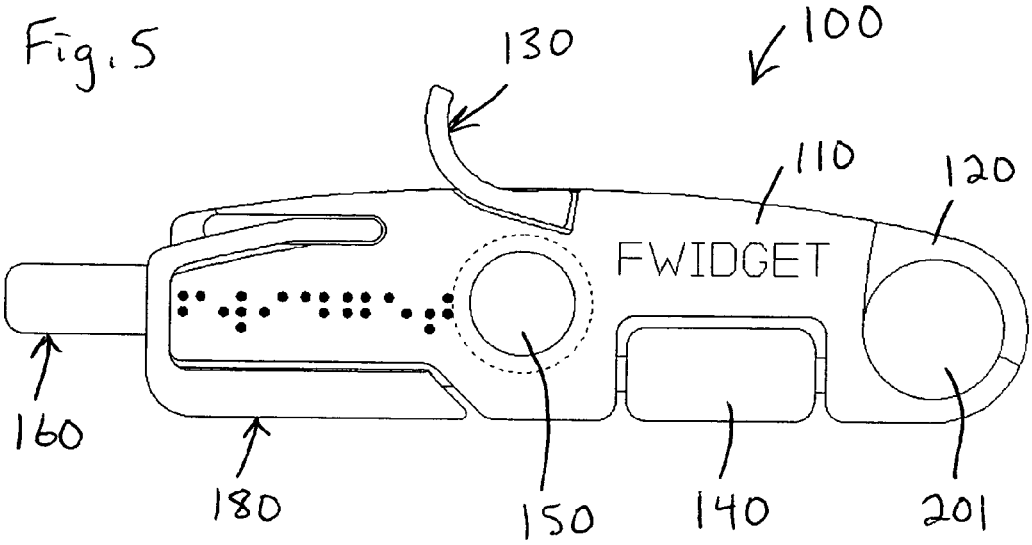
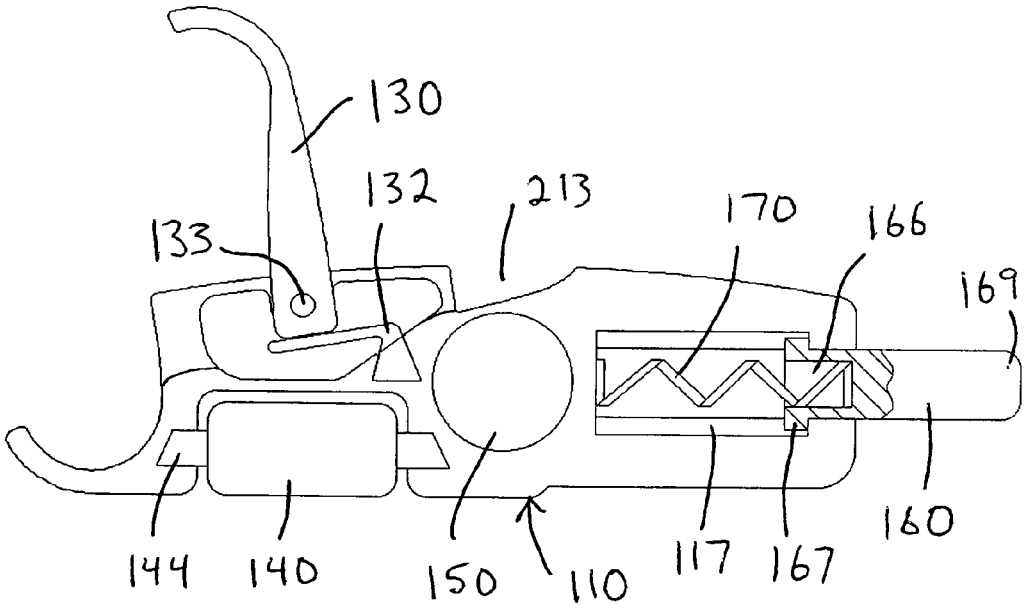
Fig. 6

Fig. 16
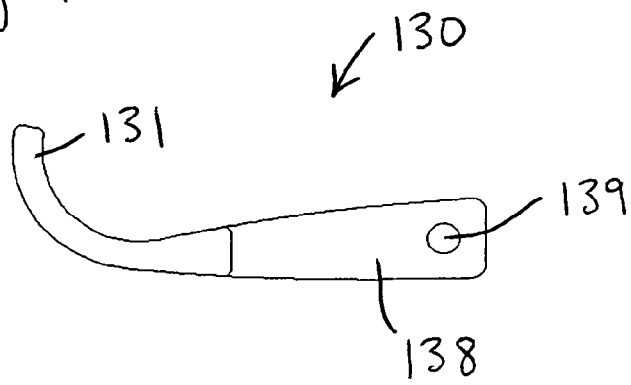
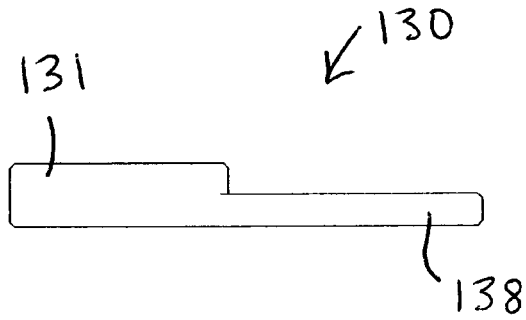
Fig. 17
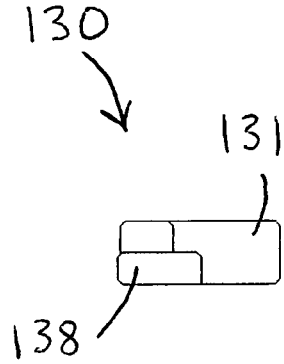
Fig. 18
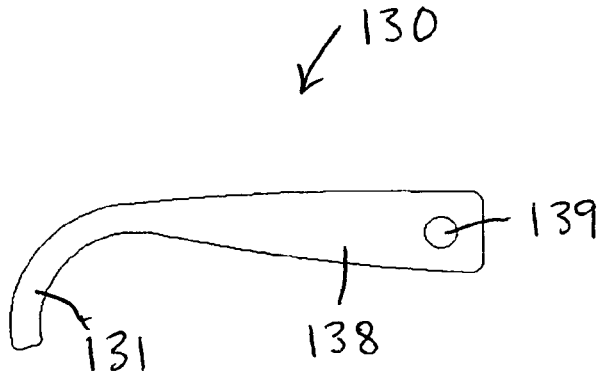
Fig. 19

HAND-HELD AMUSEMENT DEVICES AND METHODS INVOLVING SAME

FIELD OF THE INVENTION

The present invention relates to hand-held devices having various features that are designed to accommodates people's needs, desires, and/or habits to "fiddle" with things.

BACKGROUND OF THE INVENTION

Many people tend to perform secondary tasks while working on a primary task. Examples of such behavior include playing with a pen or pencil when writing; tapping fingers when thinking of what to type; and fiddling with whatever small objects are available when speaking on the phone. In many instances, the object associated with the secondary task is not specifically designed with the secondary task in mind. An object of the present invention is to provide devices that are designed to accommodate a variety of so-called "secondary tasks" or diversions.

SUMMARY OF THE INVENTION

The present invention may be described in terms of a hand-held amusement device having a variety of features that facilitate manipulative activities in and/or by a person's hand. These features may include various combinations of: a base that is configured for rocking back and forth on a support surface; a rotatable cylinder on the device; a telescoping plunger on the device; a sliding clip on the device; a pivoting lever on the device; a hole extending through an end of the device; at least one word embossed in braille on the device; and a spherical ball that is rotatably mounted in the device and protrudes outward from the device. Also, the device may be configured for rotation about as many as three orthogonal axes while being held in respective positions between a person's thumb and an opposing finger. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views, FIG. 1 is a top view of a preferred embodiment amusement device constructed according to the principles of the present invention;

FIG. 2 is a side view of the amusement device of FIG. 1;

FIG. 3 is a bottom view of the amusement device of FIG. 1;

FIG. 4 is an opposite side view of the amusement device of FIG. 1;

FIG. 5 is a top view of the amusement device of FIG. 1, showing certain parts in alternative positions;

FIG. 6 is a partially sectioned bottom view of the amusement device of FIG. 1 with the second base member (of FIGS. 9–10) removed;

FIG. 16 is a top view of a lever on the amusement device of FIG. 1;

FIG. 17 is a side view of the lever of FIG. 16;

FIG. 18 is an end view of the lever of FIG. 17; and

FIG. 19 is a bottom view of the lever of FIG. 16.

DETAILED DESCRIPTION OF A PREFERRED EMBODIMENT

Figure 8:
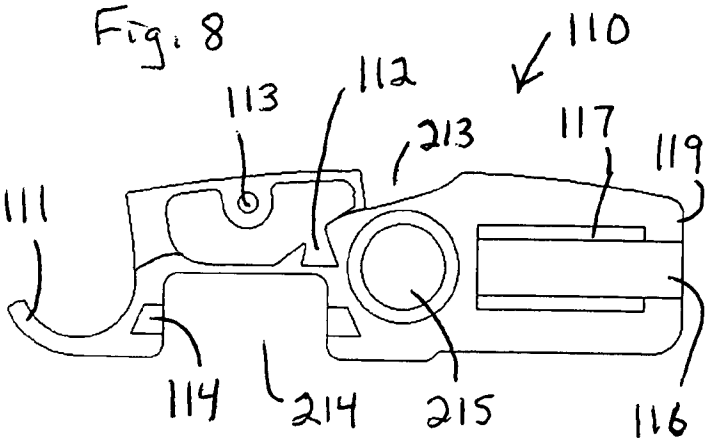
FIG. 8 is a bottom view of the first base member of FIG. 7.

A preferred embodiment amusement device constructed according to the principles of the present invention is designated as 100 in FIGS. 1–5 (which are drawn to scale). The preferred embodiment device 100 includes first and second base members 110 and 120 that are secured together to form a body or base sized and configured to be held in a person's hand and/or stored in a person's pocket. The members 110 and 120 are preferably injection molded plastic, and they may be secured together by adhesives, welding, fasteners, or other suitable means known in the art. Registration pegs and mating holes or other suitable means may be used to maintain the two members 110 and 120 in proper alignment with one another.

The preferred embodiment body has a length of approximately five and one-half inches, a width of approximately one and one-quarter inches, and a thickness of approximately one-half inch. However, the dimensions may alternatively be described in terms of ranges, including a length from three inches to six inches, a width from one-half inch to one and one-half inches, and a thickness from one-half inch to one inch. Among other things, these dimensions allow the base to be spun about three orthogonal axes when held in respective positions between a person's thumb and an opposing finger. In any event, the preferred embodiment 100 may also be described as sized and configured to be grasped in a manner similar to hand-held objects such as hammers, tennis racquets, and utility knives, although various aspects of the present invention may be implemented in other configurations, as well.

The preferred embodiment body may also be described in terms of a first side bounded by a portion of a cylindrical surface that bows or curves outward in the middle, and an opposite, second side bounded by a plane. The width of the preferred embodiment body is measured between these two sides (along a radius of the curved surface that extends perpendicular to the straight surface). The preferred embodiment body also has opposite top and bottom sides bounded by respective, parallel planes. The thickness of the preferred embodiment is measured between these parallel planes. The top side is defined by an outer surface on the first base member 110, and the bottom side is defined by an outer surface on the second base member 120.

Figure 7:
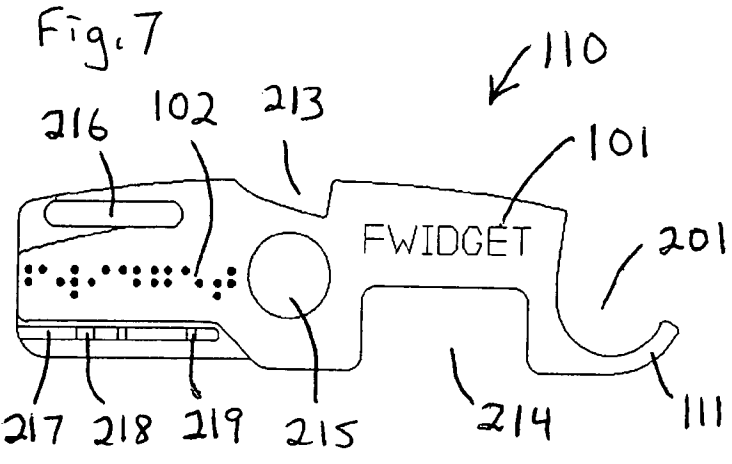
FIG. 7 is a top view of a first base member on the amusement device of Figure.

The first base member 110 is shown by itself in FIGS. 7–8. A partial spherical opening 215 is defined in the middle of the first base member 110 to accommodate a portion of a spherical ball 150, as further described below. A notch 213 extends into a first side of the first base member 110 (the same side that is described elsewhere as the first, curved side of the body) for reasons described below. The notch 213 may be described as laterally adjacent the opening 215.

In a first longitudinal direction away from the opening 215, a portion of the first base member 110 proximate the curved side is configured to accommodate a lever 130, as further described below. In this regard, the first base member 110 is notched and defines an internally accessible hole 113 to accommodate an end of a shaft 133 that is associated with the lever 130, as further described below. Also, an internally accessible cavity 112 is defined in the first base member 110 to accommodate an end of a leaf spring 132 that is also associated with the lever 130 and further described below.

At the same general longitudinal location along the first base member 110, a notch 214 extends into an opposite, second side of the first base member 110 (the same side that is described elsewhere as the second, flat side of the body) to accommodate a cylinder 140, as further described below. Grooves 114 extend into the first base member 110 at opposite ends of the notch 214 to accommodate respective ends of a shaft 144 that is associated the cylinder 140, as further described below. A first end 111 of the first base member 110, disposed in the same first longitudinal direction away from the opening 215, is configured as a hook that bounds part of a circular opening 201, as further described below.

In an opposite, second longitudinal direction away from the opening 215, an internally accessible channel 116 extends longitudinally from a closed, inner end that is proximate the opening 215, to an open, outer end that terminates together with the opposite, second end 119 of the first base member 110. First and second internally accessible grooves 117 extend along opposite sides of the channel 116 but terminate short of the second end 119 of the first base member 110. The grooves 117 and the channel 116 accommodate respective portions of a plunger 160, as further described below.

In the same, second longitudinal direction away from the opening 215, the external side of the base member 110 is configured to accommodate a clip 180, as further described below. In this regard, portions of both base members 110 and 120 are configured to define rails that are straddled by respective portions of the clip 180. An externally accessible channel 216 extends longitudinally along the top of the base member 110, proximate the curved side, to accommodate part of the clip 180. An externally accessible groove 217 extends longitudinally along the top of the base member 110, proximate the straight side, to accommodate another part of the clip 180. A stop 218 spans the groove 217 to prevent unintentional removal of the clip 180 from the base, and bumps 219 span the groove 217 to define latched positions for the clip 180 relative to the base.

The top side of the base member 110 includes room for information or texturing (e.g. the FWIDGET logo 101) in a region overlying the leaf spring 132, and room for information or texturing (e.g. FWIDGET embossed in braille 102) in a region overlying the plunger channel 116. These same regions provide bearing surfaces on which you can place your fingers in a manner that straddles the ball 150 (for reasons described below). In other words, these regions may be described in terms of respective first and second upwardly facing bearing surfaces disposed on opposite sides of the ball, each of which extends parallel to the length of the base member 110 for a distance at least as great as the diameter of the ball 150.

Figure 10:
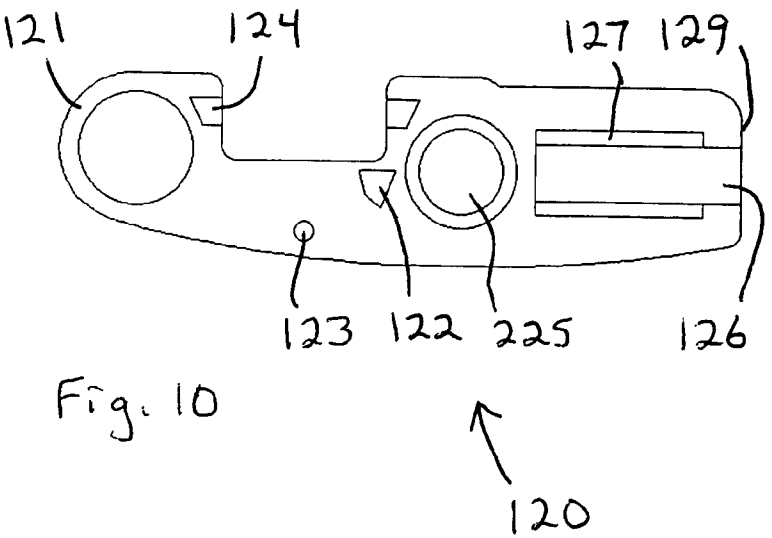
FIG. 10 is a top view of the second base member of FIG. 9.
Figure 9:
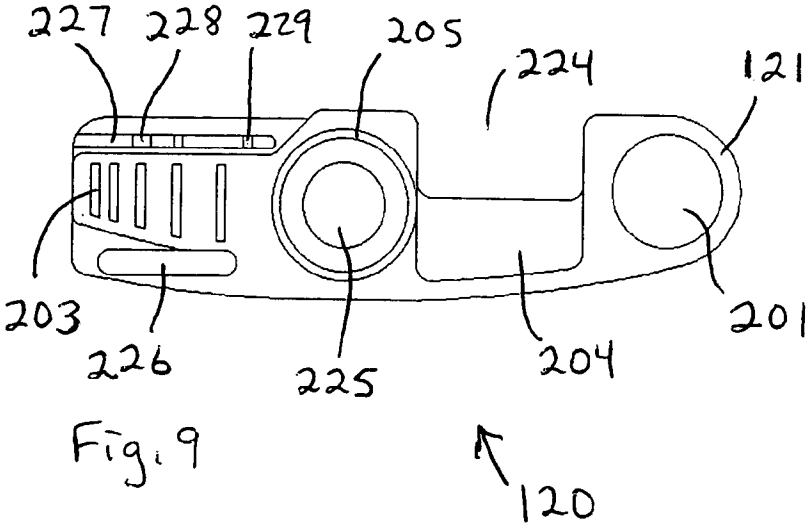
FIG. 9 is a bottom view of a second base member on the amusement device of FIG. 1.
Figure 14:
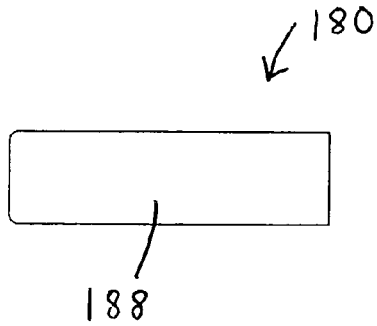
FIG. 14 is a side view of the clip of FIG. 11.
Figure 12:
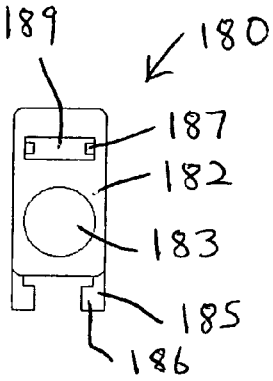
FIG. 12 is an end view of the clip of FIG. 11.
Figure 11:
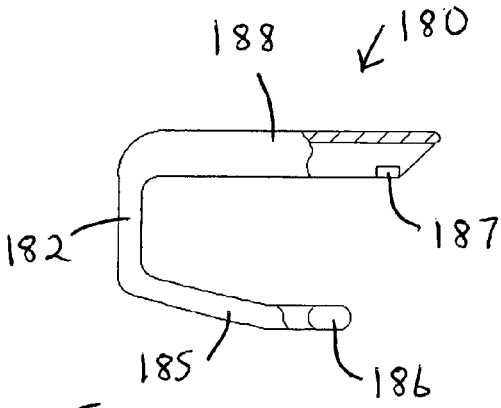
FIG. 11 is a partially sectioned top view of a clip on the amusement device of FIG. 1.
Figure 13:
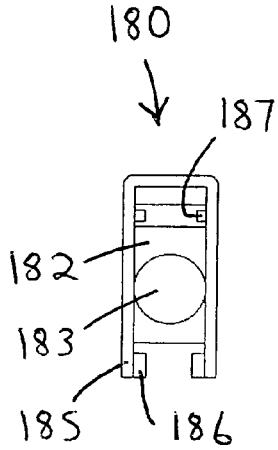
FIG. 13 is an opposite end view of the clip of FIG. 11.
Figure 15:
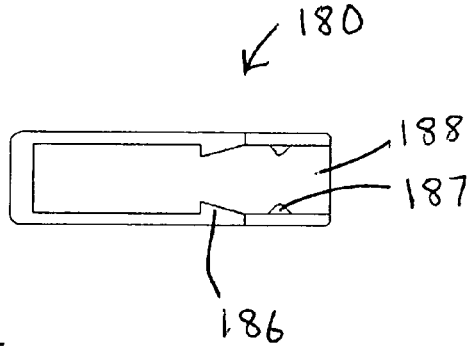
FIG. 15 is an opposite side view of the clip of FIG. 11.

The second base member 120 is shown by itself in FIGS. 9–10. A partial spherical opening 225 is defined in the middle of the second base member 120 to accommodate a portion of the spherical ball 150. In a first longitudinal direction away from the opening 225, the second base member 120 defines an internally accessible hole 123 to accommodate an opposite end of same shaft 133. Also, an internally accessible cavity 122 is defined in the second base member 120 to accommodate an end of the leaf spring 132.

At the same general longitudinal location along the second base member 120, a notch 224 extends into an opposite, second side of the second base member 120 (the same side that is described elsewhere as the second, flat side of the body) to accommodate the cylinder 140. Grooves 124 extend into the second base member 120 at opposite ends of the notch 224 to accommodate respective ends of the shaft 144. A first end 121 of the second base member 120, disposed in the same first longitudinal direction away from the opening 225, is configured as a closed loop that bounds the circular opening 201.

In an opposite, second longitudinal direction away from the opening 225, an internally accessible channel 126 extends longitudinally from a closed, inner end that is proximate the opening 225, to an open, outer end that terminates together with the opposite, second end 129 of the second base member 120. First and second internally accessible grooves 127 extend along opposite sides of the channel 126 but terminate short of the second end 129 of the second base member 120. The grooves 127 and the channel 126 accommodate respective portions of the plunger 160.

In the same, second longitudinal direction away from the opening 225, the external side of the base member 120 is configured to accommodate the clip 180. As noted above, portions of the base members 110 and 120 are configured to define rails that are straddled by respective portions of the clip 180. An externally accessible channel 226 extends longitudinally along the top of the base member 110, proximate the curved side, to accommodate part of the clip 180. An externally accessible groove 227 extends longitudinally along the top of the base member 110, proximate the straight side, to accommodate another part of the clip 180. A stop 228 spans the groove 227 to prevent unintentional removal of the clip 180 from the base, and bumps 229 span the groove 227 to define latched positions for the clip 180 relative to the base.

The top side of the base member 120 includes a recessed area 204 in a region overlying the leaf spring 132, and aligned with the notch 224. This recessed area 204 increases accessibility to the cylinder 140. The top side of the base member 120 also includes room for information or texturing (e.g. ridges 203 spaced apart from one another by distances that grow progressively larger) in a region overlying the plunger channel 126, and room for information or texturing (e.g. the circular ridge 205) in a region surrounding the opening 225.

FIGS. 16–19 show the lever 130 by itself. The lever 130 may be described as a hook-shaped member having a base end 138 that is approximately one-half as thick as the first base member 110, and a hooked end 131 that is approximately equal in thickness to the first base member 110. A hole 139 extends through the base end 138 to receive the shaft 133 (which is preferably a steel pin). On an alternative embodiment, the shaft 133 and the lever 130 are formed as a single integral part.

FIG. 6 shows how the lever 130 and the leaf spring 132 are positioned relative to the first base member 110. The hole 139 in the lever 130 is aligned with the hole 113 in the base member 110, and the hooked end 131 of the lever 130 is arranged to oppose the hooked end 111 of the base member 110. The leaf spring 132 has a relatively thicker, trapezoidal base that projects into the cavity 112 in the base member 110, and that projects into the similar cavity 122 in the base member 120, as well. The opposite, distal end of the leaf spring 132 bears against the base end 138 of the lever 130. The leaf spring 132 bears against respective bearing surfaces on the lever 130 to bias the lever 130 to remain in one of three orientations (shown in FIGS. 1, 5, and 6). The spring 132 may be described as a means for biasing the lever to remain in any of these orientations and/or resisting movement of the lever from these orientations.

FIG. 6 also shows how the cylinder 140 and the shaft 144 are positioned relative to the first base member 110. A hole extends lengthwise through the cylinder 140 to rotatably receive the shaft 144 (which is preferably a steel pin). As with the lever 130 and the shaft 133, the cylinder 140 and the shaft 144 are formed as a single integral part on an alternative embodiment (in which case the ends of the "shaft" are cut straight across to eliminate any impediment to rotation relative to the base). On the preferred embodiment 100, the ends of the shaft 144 are beveled to match the shape of the grooves 114 and 124 in respective base members 110 and 120.

FIG. 6 also shows how the spherical ball 150 is positioned relative to the first base member 110. The ball 150 is preferably made of steel and sized and configured to be retained between the base members 110 and 120, while remaining free to rotate relative thereto and protruding outward therefrom.

FIG. 6 also shows how the plunger 160 and an associated coil spring 170 are positioned relative to the first base member 110. The plunger 160 is preferably an injection molded, tubular member having a rounded, closed end 169 that protrudes outward beyond the base, and an opposite, open end disposed inside the base. Tabs 167 extend outward from diametrically opposed portions of the plunger 160, proximate its interior end, and travel along respective channels 117 and 217 in the base members 110 and 120. The tabs 167 prevent removal of the plunger 160 from the fully assembled base. A bore 166 extends into the open end of the plunger 160, and the spring 170 is compressed between the end wall of the bore 166 and the interior end walls of the channels 116 and 126. The spring 170 may be described as a means for biasing the plunger 160 outward, and/or resisting inward movement of the plunger 160. The bore 166 may be made relatively deeper into the plunger 160 to receive a ballast weight if deemed necessary to help make the center of mass of the device 100 coincidental with the center of the ball 150.

The device 100 is assembled by arranging the parts shown in FIG. 6 in the manner shown in FIG. 6; aligning the second base member 120 relative thereto; and securing the second base member 120 to the first base member 110. The clip 180 is then forced onto the base until it snaps into engagement with the grooves 216–217 and 226–227 as further explained below.

FIGS. 11–15 show the clip 180 by itself. The clip 180 may be described as a generally U-shaped member that is preferably injection molded plastic. A central portion 182 of the clip 180 spans part of the second ends 119 and 219 of respective base members 110 and 120, and defines a hole 183 that is configured to accommodate passage of the protruding end of the plunger 160. Opposing legs 185 extend away from a first end of the central portion 182, and tabs 186 on the distal ends of the legs 185 snap into respective grooves 216 and 226. A U-shaped leg 188 extends away from an opposite, second end of the central portion 182, and opposing nubs 187 on the distal end of the leg 188 snap into respective grooves 217 and 227. A window 189 extends through the central portion 182 to facilitate formation of the nubs 187 by injection molding. The tabs 186 and the nubs 187 prevent unintentional removal of the cap 180 from the base, and the nubs 187 may also be described as means for biasing the cap 180 to remain in either of the positions shown in FIGS. 3 and 5, and/or for resisting movement of the cap 180 from either of these positions.

When the cap 180 occupies the position shown in FIG. 3, the plunger 160 is substantially covered, and the legs 185 effectively extend the curved side of the base, thereby facilitating rocking the device 100 back and forth on a support surface. The cap 180 may also serve as a source of amusement by sliding back and forth along the base, and/or clicking into and out of latched positions relative to the base.

When the cap 180 occupies the position shown in FIG. 5, substantially more of the plunger 160 is exposed and available for interaction with a user. One way to use the plunger 160 for amusement purposes is to push it inward with your thumb while holding the base in your hand. Another option is to position the plunger 160 against a support surface, and push down on the device 100. Yet another possibility is to position the plunger 160 proximate a support surface and let the device 100 "bounce" against the support surface.

The ball 150 facilitates multiple amusement activities, as well. For example, you can use a thumb or finger to rotate the ball 150 while holding the device 100 in your hand. You can also hold the ball 150 between your thumb and an opposing finger, and spin the base relative to the ball 150. Yet another available option is to place the ball 150 on a support surface; place your fingers on the base in a manner that straddles the ball 150 (with respective fingers bearing on regions overlying the leaf spring 132 and the plunger channel 116, respectively; and roll or "surf" the device 100 across the support surface. Alternatively, when the ball 150 is on the support surface, you can place a finger on the ball 150, and spin the base about the ball 150.

The cylinder 140 may be rotated by a thumb or finger when the device 100 is being held in your hand. Also, the cylinder 140 may be rolled against a support surface or the edge of a support surface. Moreover, depending on the embodiment, the cylinder 140 may be moved axially back and forth between the end walls of the notches 214 and 224.

The lever 130 may be pivoted by a thumb or finger when the device 100 is being held in your hand. The lever 130 may be pivoted from the position shown in FIG. 6, toward the position shown in FIG. 1 to "pinch" a finger or other object between the hooked end 131 and the first end 121 of the base member 120. Also, when the lever 130 is moved to the position shown in FIG. 5, the hooked end 131 is configured to "hang" on a finger or thumb. Alternatively, the protruding hooked end 131 may be positioned on a support surface to facilitate spinning of the device 100 relative to the support surface (when a finger is positioned on a diametrically opposite portion of the base), or the device 100 may be spun while holding the opposite curved and straight sides of the base between your thumb and an opposing finger.

The opening 201 accommodates still more amusing activities. For example, you can stick a finger through the hole 201 and "twirl" the device 100 about your finger. Alternatively, you can stick a pencil (or rubber band) through the hole 201; grab the opposite ends of the pencil (or rubber band) in opposite hands; and "whirl" the device 100 about the pencil or (rubber band).

Additional amusement features are integrated into the base itself. For example, the braille letters 102 and the ridges 203 and 204 provide interesting textures to rub your thumb or fingers across. Also, the size of the base is such that you can hold the device 100 lengthwise between your thumb and an opposing finger, and spin the device 100 about its longitudinal axis.

The present invention may also be described in terms of methods of amusement, wherein various combinations of the foregoing activities are performed using the device 100, and/or still more amusing activities are performed as such uses become apparent to people who use the device 100. The device 100 and/or its description will also lead people to derive other amusing devices that incorporate the spirit of the present invention. For example, people might substitute a new feature for one of the depicted features (e.g. replace the hole 201 with a magnet), or add a feature (e.g add a magnet inside the outer tip of the plunger 160), or alter an existing feature (e.g. magnetizing the ball 150). People also might be inclined to arrange various features of the present invention in different ways, and/or to use alternative structures to achieve the same results. Among other things, for example, the ball may be integrated into the base members to make the resulting device less expensive to manufacture and/or less heavy to carry in your pocket. Recognizing that the present invention is described with reference to a preferred embodiment and a particular application that will lead persons skilled in the art to derive additional embodiments, applications, and/or improvements, the scope of the present invention is to be limited only to the extent of the following claims.

What is claimed is:

1. A hand-held amusement device, comprising:

a spherical ball that defines a diameter; and a base having a length up to six inches and at least three times as great as the diameter, wherein the base is configured to be held in a person's hand, and the ball is rotatably mounted in the base in such a manner that respective portions of the ball protrude outward from opposite sides of the base, and a person can hold the ball between a finger and opposing thumb and spin the base about the ball, and alternatively, a person can place his fingers on the base in a manner that straddles the ball and roll the device across a support surface, wherein a hole extends through an end of the base, whereby a person can alternatively insert a finger through the hole and spin the device about the finger.

2. The amusement device of claim 1, further comprising a cylinder rotatably mounted on the base.

3. The amusement device of claim 2, wherein a portion of the cylinder protrudes outward from the base, whereby a person can roll the cylinder against the support surface.

4. The amusement device of claim 2, wherein a notch in the base exposes more than half of an outer cylindrical surface defined by the cylinder.

5. The amusement device of claim 1, further comprising a lever pivotally mounted on the base.

6. The amusement device of claim 1, wherein at least one word is embossed in braille on the base.

7. The amusement device of claim 1, wherein an outside edge of the base is bounded by an arcuate surface, and a person can place fingers on a side of the base opposite the arcuate surface and rock the device back and forth on the support surface.

8. The amusement device of claim 1, further comprising a plunger movably mounted in telescoping fashion on the base.

9. A hand-held amusement device, comprising:

a spherical ball that defines a diameter; and a base having a length up to six inches and at least three times as great as the diameter, wherein the base is configured to be held in a person's hand, and the ball is rotatably mounted in the base in such a manner that respective portions of the ball protrude outward from opposite sides of the base, and a person can hold the ball between a finger and opposing thumb and spin the base about the ball, and alternatively, a person can place his fingers on the base in a manner that straddles the ball and roll the device across a support surface, wherein an outside edge of the base is bounded by an arcuate surface that extends substantially the length of the base, whereby a person can alternatively place fingers on a side of the base opposite the arcuate surface and rock the device back and forth on the support surface.

10. The amusement device of claim 9, wherein the side is bounded by a flat surface that extends substantially the length of the base.

11. The amusement device of claim 3, further comprising a plunger movably mounted in telescoping fashion on the base.

12. A hand-held amusement device, comprising:

a spherical ball that defines a diameter;

a base having a length up to six inches and at least three times as great as the diameter, wherein the base is configured to be held in a person's hand, and the ball is rotatably mounted in the base in such a manner that respective portions of the ball protrude outward from opposite sides of the base, and a person can hold the ball between a finger and opposing thumb and spin the base about the ball, and alternatively, a person can place his fingers on the base in a manner that straddles the ball and roll the device across a support surface; and a plunger movably mounted in telescoping fashion on the base.

13. The amusement device of claim 12, wherein the plunger is resiliently biased to protrude outward beyond a first end of the base.

14. The amusement device of claim 13, further comprising a clip slidably mounted on the first end of the base.

15. The amusement device of claim 14, wherein the clip is movable between an extended position covering a relatively larger portion of the plunger, and a retracted position covering a relatively smaller portion of the plunger.

16. The amusement device of claim 15, wherein the clip resiliently snaps into and out of each said position.

17. A hand-held amusement device, comprising:

a spherical ball that defines a diameter;

a base having a length up to six inches and at least three times as great as the diameter, wherein the base is configured to be held in a person's hand, and the ball is rotatably mounted in the base in such a manner that respective portions of the ball protrude outward from opposite sides of the base, and a person can hold the ball between a finger and opposing thumb and spin the base about the ball, and alternatively, a person can place his fingers on the base in a manner that straddles the ball and roll the device across a support surface; and a lever pivotally mounted on the base, wherein the lever is resiliently biased to remain in a retracted position within a perimeter defined by the base.

18. The amusement device of claim 17, wherein the lever is movable to an extended position protruding outward from the perimeter of the base.

19. The amusement device of claim 17, wherein a hole extends through an end of the base.

20. The amusement device of claim 19, wherein the lever is configured and arranged to align with the hole when in the retracted position.

21. A hand-held amusement device, comprising:

a base, wherein the base is less than six inches long, whereby a person can hold the device lengthwise between a thumb and an opposing finger and spin the device; and at least three amusing means on the base for amusing a person by providing manipulative exercises involving the person's hand, wherein the amusing means are selected from the group comprising:

(a) an outside edge of the base that is bounded by an arcuate surface and extends substantially the length of the base, whereby the person can place fingers on a side of the base opposite the arcuate surface and rock the device back and forth on a support surface;

(b) a cylinder rotatably mounted on the base, whereby the person can spin the cylinder;

(c) a plunger movably mounted in telescoping fashion on the base and resiliently biased to protrude outward beyond a first end of the base, whereby the person can push the plunger toward the base;

(d) a clip slidably mounted on the base and resiliently biased to remain in a latched position relative to the base, whereby the person can snap the clip into and out of the latched position;

(e) a lever pivotally mounted on the base and resiliently biased to remain in a latched position relative to the base, whereby the person can urge the lever away from the latched position;

(f) a hole extending through a second end of the base, whereby a person can insert a finger through the hole and spin the device about the finger; and (g) at least one word embossed in braille on the base.

22. The amusement device of claim 21, wherein the group further comprises a spherical ball rotatably mounted in the base in such a manner that a portion of the ball protrudes outward from the base, and the base provides first and second upwardly facing bearing surfaces on opposite sides of the ball, whereby a person can place at least one finger on each of the bearing surfaces and roll the device across the support surface.

23. The amusement device of claim 21, wherein the base is configured to be spun about three orthogonal axes extending through the base while the base is supported in respective positions between a person's thumb and an opposing finger.

24. The amusement device of claim 21, wherein at least five of the amusing means are provided on the base.

25. A hand-held amusement device, comprising:

a base less than six inches long, wherein the base is sized and configured to be held in hand between a person's thumb and opposing finger, and selectively spun about an axis extending between the thumb and the opposing finger;

a spherical ball rotatably mounted in the base in such a manner that a portion of the ball protrudes outward from the base, and a person can roll the ball relative to the base;

a plunger movably mounted in telescoping fashion on the base and resiliently biased to protrude outward beyond a first end of the base, whereby a person can push part of the plunger into the base; and a hole extending through an opposite, second end of the base, whereby a person can insert a pencil through the hole and spin the device about the pencil.

26. A hand-held amusement device, comprising:

a spherical ball that defines a diameter; and a base having a length up to six inches and at least three times as great as the diameter, wherein the base is configured to be held in a person's hand, and the ball is rotatably mounted in the base in such a manner that respective portions of the ball protrude outward from opposite sides of the base, and a person can hold the ball between a finger and opposing thumb and spin the base about the ball, and alternatively, a person can place his fingers on the base in a manner that straddles the ball and roll the device across a support surface, and wherein at least one word is embossed in braille on the base.

27. The amusement device of claim 26, wherein an outside edge of the base is bounded by an arcuate surface, and a person can place fingers on a side of the base opposite the arcuate surface and rock the device back and forth on the support surface.

28. The amusement device of claim 26, further comprising a plunger movably mounted in telescoping fashion on the base.

* * * * *